United States Patent [19]

Charboneau

[11] Patent Number: 4,459,444

[45] Date of Patent: Jul. 10, 1984

[54] CONDITION RESPONSIVE SWITCH

[75] Inventor: Thomas J. Charboneau, Norton, Mass.

[73] Assignee: Texas Instruments Incorporated, Dallas, Tex.

[21] Appl. No.: 448,106

[22] Filed: Dec. 9, 1982

[51] Int. Cl.[3] ..... H01H 35/34

[52] U.S. Cl. ..... 200/83 P

[58] Field of Search ..... 200/81 R, 83 R, 83 B, 200/83 J, 83 P, 83 S, 83 SA, 83 Y, 67 DA, 290; 337/343

[56] References Cited

U.S. PATENT DOCUMENTS

| | | | |
|---|---|---|---|
| 4,272,660 | 6/1981 | Mayer et al. | 200/83 P |
| 4,287,780 | 9/1981 | Poling | 200/83 P X |
| 4,330,695 | 5/1982 | Poling | 200/83 S X |
| 4,334,210 | 6/1982 | Boulanger et al. | 337/343 |
| 4,342,887 | 8/1982 | Sanford | 200/83 P |
| 4,349,806 | 9/1982 | Boulanger | 337/343 |

*Primary Examiner*—J. R. Scott

*Attorney, Agent, or Firm*—James P. McAndrews; John A. Haug; Melvin Sharp

[57] ABSTRACT

A thermal or pressure responsive switch has a contact arm movable between switch positions opening and closing switch contacts, has a spring biasing the arm to one of the switch positions, and has a dished disc element movable with snap action between original and dished configurations during changes in pressure or temperature conditions. The dished disc element cooperates with the spring in moving the contact arm between switch positions on the occurrence of selected switch actuating or reset pressure or temperature conditions, and the switch components are arranged to permit overtravel of the disc during snap acting movement for closing switch contacts without substantially altering the pressure or temperature response characteristics of the switch.

5 Claims, 4 Drawing Figures

CONDITION RESPONSIVE SWITCH

BACKGROUND OF THE INVENTION

The field of this invention is that of condition responsive switches and the invention relates more particularly to switches using dished disc elements which move between original and inverted dished configurations with snap action in response to the occurrence of selected temperature or pressure conditions.

The conventional condition responsive switches have a contact arm movable between first and second switch positions, have a spring biasing the arm to one switch position, and have a dished disc element movable between original and inverted dished configurations with snap action for moving the switch between switch positions in response to the occurrence of selected temperature or pressure conditions. Such switches are intended to perform selected control functions in response to the occurrence of the selected temperatures or pressures in a zone to be monitored but it is found that forces applied to the disc elements during assembly in the switches alter the temperatures or pressures at which the disc elements move for actuating the switches. Various switch structures have been proposed for limiting such variations in forces applied to the discs during switch manufacture, assembly, and use so that the switches will display consistently and reliably reproducible condition response characteristics. However, it is found that reaction forces applied to the discs due to overtravel of the discs during snap acting disc movement for closing switch contacts in known switch structures frequently result in undesirably large variations in the thermal or pressure response characteristics of the switches.

SUMMARY OF THE INVENTION

It is an object of this invention to provide a novel and improved condition responsive switch; to provide such a switch having components which are easily and inexpensively manufactured and assembled for providing the switches with consistent and reliable condition response characteristics; to provide such a switch utilizing a dished disc element which is movable between original and inverted dished configurations with snap action in response to the occurrence of selected pressure or temperature conditions wherein overtravel movement of the disc element in closing switch contacts during such snap action is accommodated without substantially altering the thermal or pressure response characteristics of the switch; and to provide such a novel and improved switch which is of simple, rugged and inexpensive construction.

Briefly described, the novel and improved condition responsive switch of this invention comprises movable contact means which are mounted on a base to be movable between an open circuit position spaced from complementary stationary contacts mounted on the base and a closed circuit position engaged with the stationary contacts. The movable contact means comprise terminal means mounted on the base having a first pivot surface disposed over the base in spaced, facing relation to the base. The movable contact means further includes a rigid contact arm having a complementary pivot surface formed at one end of the arm, the arm being disposed with its complementary pivot surface arranged in facing relation to the first pivot surface on the terminal means so that the two pivot surfaces are adapted to engage each other and so that the arm is adapted to pivot around the point of that engagement for moving the opposite end of the arm between the noted switch positions. A spring means, preferably comprising a flat spring having a relatively low spring rate and preferably having a bight formed intermediate the spring ends, is connected at one end to the terminal means and at its opposite end to the contact arm for biasing the complementary pivot surface on the arm into engagement with the first pivot surface on the terminal means. The spring means also biases the arm to pivot the arm to move the opposite end of the arm to one of said switch positions. Preferably the spring also serves to electrically connect the terminal means to the contact arm. A condition responsive means including a dished disc element which is arranged to move between original and dished configurations with snap action in response to changes in pressure or temperature conditions is disposed for cooperating with the switch arm in moving the arm between the switch positions in response to the occurrence of selected pressure and/or temperature conditions.

Preferably the spring means is arranged to bias the contact arm to an open contacts switch position and the condition responsive means is arranged with the dished disc element thereof disposed in an original dished configuration holding the contact arm in a closed contacts position against the spring bias. The dished disc element is adapted to move to an inverted dished configuration with snap action for permitting sharp opening of the switch contacts on the occurrence of a selected actuating pressure or temperature condition or the like. On the occurrence of a subsequent reset temperature or pressure condition the dished element is adapted to return to its original configuration with snap action for moving the contact arm back into its closed contacts position against the spring bias. In that arrangement, that portion of the snap-acting movement of the disc element which moves the switch contacts to closed contacts position pivots the contact arm against a spring having a relatively low spring rate so that the reaction forces applied to the disc element during that portion of the snap-acting disc movement are relatively limited and do not substantially alter the subsequent condition response characteristics of the element. Additional snap-acting movement of the disc element then continues and builds a desired contact force between the switch contacts. Finally, additional overtravel type of snap-acting disc movement such as might be due to tolerances in switch assembly and variations in locating the disc element on the switch device or the like tends to move the contact arm to move the complementary pivot surface of the arm out of engagement with the first pivot surface on the terminals means against the bias of the noted spring. In that way, the reaction forces applied to the disc element during build up of the desired contact engaging force tend to be very consistent and do not adversely effect manufacture of switches having consistently reproducible condition response characteristics. Further, the reaction forces applied to the disc element due to overtravel of the disc result primarily from movement of a spring having a relatively low spring rate and those reaction forces therefore have little effect in varying the subsequent condition response characteristics of the dished disc element. Accordingly the switch device of this invention is characterized by a simple, rugged and inexpensive construction but displays improved and consistently reproducible condition response characteristics over a long service life.

DESCRIPTION OF THE DRAWINGS

Other objects, advantages and details of the novel and improved condition responsive switch of this invention appear in the following detailed description of preferred embodiments of the invention, the description referring to the drawings in which.

DESCRIPTION OF PREFERRED EMBODIMENTS

Figure 1:
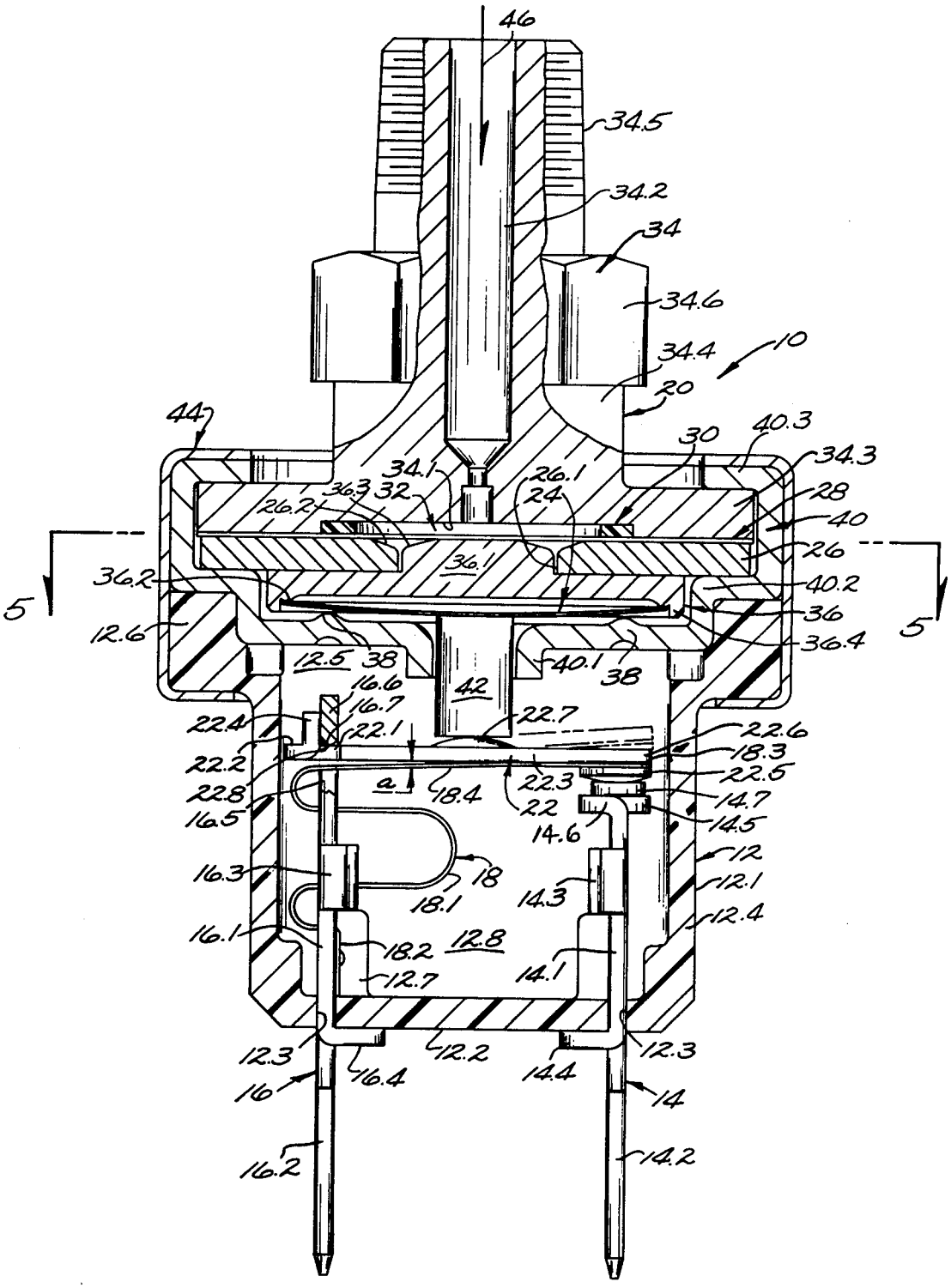
FIG. 1 is a section view along the longitudinal axis of a preferred embodiment of the novel and improved pressure switch device of this invention.

Referring to the drawings, 10 in FIG. 1 indicates the novel and improved condition responsive switch of this invention which is exemplified in FIG. 1 as a pressure switch device comprising a base means 12, stationary contact means 14 mounted on the base, movable contact means 16 mounted on the base for movement between alternate switch positions into and out of electrical engagement with the stationary contact means 14, spring means 18 biasing the movable contact means to one of the switch positions, and condition responsive means 20 for cooperating with the spring means and moving the movable contact means between switch positions on the occurrence of selected pressure conditions or the like.

Preferably for example, the base means 12 comprises a generally cylindrical, cup-shaped housing or body 12.1 formed of a rigid, electrically insulating thermoplastic material or the like having a bottom 12.2 with openings 12.3 therein, having a side wall 12.4, having an open end 12.5, and having an integral mounting flange 12.6 extending around the open end of the housing. Preferably integral abutments 12.7 are formed inside the housing body chamber 12.8 adjacent to the opening 12.3. In that embodiment, the stationary contact means preferably comprises a first rigid terminal plate member 14.1 formed of a rigid, electrically conductive material such as copper, brass, or bronze or the like which fits through one of the openings 12.3 in the housing bottom 12.2, a terminal post 14.2 extending outside of the housing for permitting electrical connection to be made to the first terminal member, a pair of wings 14.3 (only one being shown) on respective sides of the terminal member to engage respective abutments 12.7 inside the housing chamber, a pair of tabs 14.4 (only one being shown) on respective opposite sides of the terminal post engaging the outer side of the housing bottom 12.2 for securing the terminal member securely in the opening 12.3 against abutments 12.7, a contact seat 14.5 struck and bent out of the upstanding end 14.6 of the first terminal plate member, and an electrical contact 14.7 mounted on the seat by welding or soldering or the like, the contact preferably being formed of a precious metal or other material having desired contact wear and resistance characteristics in conventional manner.

In accordance with this invention, the movable contact means 16 includes a second, rigid terminal plate member 16.1 of an electrically conductive copper, brass or bronze material or the like having a terminal post 16.2, having wings 16.3, and having mounting tabs 16.4 similar to those of the first terminal member. The second terminal member also has an opening 16.5 therein at an end 16.6 of the member upstanding from the base and has a first pivot surface 16.7 formed inside that opening at a margin of the opening where the surface is disposed over the bottom 12.2 of the base or housing in spaced, facing relation to the base bottom. Movable contact means also includes a contact arm 22 which is also preferably formed of a rigid, and typically conductive material such as steel, and is fitted into the opening 16.5 in the second terminal member as shown in FIG. 1. The contact arm has a second or complementary pivot surface 22.1 formed on the arm adjacent one end 22.2 of the arm. With the contact arm inserted in the terminal opening 16.5, that complementary pivot surface is disposed in facing relation to the first pivot 16.7 formed on the terminal member 16. Preferably the contact arm has a central portion 22.3 extending across the housing chamber 12.8 near the open end of the housing body, has a pair of lever tabs 22.4 (only one being shown) at opposite sides of the arm near the arm end 22.2 for engaging the terminal member 16 near the opening 16.5, and has an electrical contact 22.5 secured to the arm at the opposite end 22.6 of the arm to be pivoted into and out of electrically contacting engagement with the stationary contact 14.7. Preferably, the contact arm has a portion 22.7 formed therein intermediate the arm ends to be engaged for pivoting the arm, that deformed portion also typically serving to form a stiffening rib to add to the rigidity of the contact arm.

In accordance with this invention, the spring means 18 preferably comprises a flat spring formed of beryllium copper, phosphor bronze, stainless steel or other electrically conductive material having one or more bights 18.1 formed therein intermediate the ends of the spring, the spring preferably being secured at one end 18.2 by welding or riveting or the like in any conventional manner to the terminal plate member 16 and at its opposite end 18.3 in a similar manner to the contact arm 22. The spring is connected to the terminal member 16 and to the arm 22 for normally biasing the complementary pivot surface 22.1 of the arm into pivotal engagement with the first pivot surface 16.7 on the terminal member. The spring 18 also normally biases the contact arm to pivot (in a counterclockwise direction as viewed in FIG. 1) around the point 22.8 of that engagement so that the opposite end 22.6 of the arm moves the contact 22.5 away from the stationary contact 14.7. In accordance with this invention, the flat spring 18 has a relatively low spring rate as measured at the transfer pin 42 location, of 3.3 pounds per inch and preferably less than about 10 pounds per inch or less and in a preferred embodiment of the invention, the spring end 18.3 is connected to said opposite end 22.6 of the arm so that a length of the spring 18.4 extends along the arm between the arm and the base bottom 12.2 with a small angular separation a between the spring portion 18.4 and the arm.

In accordance with this invention, the condition responsive means 20 includes a dished disc spring element 24 formed of a metal spring material such as stainless steel or a thermostat bimetal or the like which is adapted to move between original and inverted dished configurations with snap action in response to the occurrence of selected pressure or temperature conditions or the like in conventional manner.

Preferably for example, the condition responsive means 20 has the dished disc element 24 arranged for cooperating with the spring 18 in moving the switch device 10 between switch positions thereof in response to changes in pressure conditions in a pressure zone to be monitored. That is, as is shown in FIG. 1, the condition responsive means comprises a support plate 26 having an opening 26.1, a flexible diaphragm 28 disposed over the support opening, a ring gasket 30 arranged concentric with the support opening for forming a pressure chamber 32 at one side of the diaphragm, and a port body 34 having a recess 34.1 fitted over the gasket to seal the chamber, having a passage 34.2 communicating with the chamber, and having a clamping or mounting ring 34.3 formed around the recess. A force converter 36 is aligned with the support opening at the opposite side of the diaphragm to be movable in response to movement of the diaphragm as the diaphragm moves in response to variation in fluid pressures applied to the diaphragm in the chamber 32. The dished disc element 24 is positioned to be engaged on one side by the force converter, and reaction means 38 are arranged to engage an opposite side of the dished disc element. In that arrangement, the dished element is adapted to move from the dished configuration shown in FIG. 1 to an inverted dished configuration with snap action when a selected actuating force is applied to the disc element through the force converter in response to application of a selected actuating fluid pressure to the diaphragm 28. The disc is also adapted to return to the illustrated dished configuration with snap action when the fluid pressure applied to the diaphragm falls to a selected, relatively lower, reset fluid pressure level. Preferably, the reaction means 38 are incorporated in a sleeve 40 which is swaged as shown in FIG. 1 for securing the various components of the condition responsive means 20 together in the illustrated manner. Preferably also, the sleeve 40 has a guide flange 40.1 slidably receiving a ceramic motion transfer pin 42 or the like for transmitting movement from the dished disc element spring 24 to the flat spring 18. Preferably the condition responsive means 20 are pretestable to assure they display desired pressure response characteristics and are then mounted on the base 12 in any conventional manner such as by having a metal mounting sleeve 44 or the like swaged around the housing flange 12.6 and around a portion of the condition responsive means 20 as shown in FIG. 1.

It should be understood that condition responsive means 20 having dished disc elements 24 arranged in any conventional manner to be responsive to changes in pressure and/or temperature conditions or the like are used in the switch device 10 in accordance with this invention. In a preferred embodiment, the pressure responsive means 20 comprises a highly reliable, easily assembled and mounted condition responsive means such as is described in a commonly-assigned, copending application Ser. No. 448,668 of the present inventor filed of even date herewith. As various types of condition responsive means including pressure responsive means and/or temperature responsive means are adapted to be used in the condition responsive switch of this invention, the condition responsive means is not specifically described herein to any further extent and it will be understood that the condition responsive means is mounted on the base means in any conventional manner so that the disc element 24 is adapted to move with snap action in response to selected changes in a pressure and/or temperature condition to be monitored and to transfer that movement to the switch arm 22 for changing switch positions within the scope of this invention.

In assembling the switch device 10, the contacts 14.7 and 22.5 are welded to the terminal 14 and arm 22, and the spring 18 is welded or riveted to the arm. The arm is slipped into place in the terminal opening 16.5 and the spring 18 has a selected shape so it is compressed to a known degree and is then welded or riveted to the terminal 16.1 to normally bias the complementary pivot surface 22.1 against the pivot surface 16.7. The terminal members 14 and 16 are mounted on the base 12 and the condition responsive means 20 is mounted on the base 12 by the swaged sleeve 44 with a motion transfer pin 42 of selected length disposed between the disc element 24 and the contact arm 22. As assembled, the arm is disposed in the switch in the position shown in FIG. 1 with the contact 22.5 engaged with the contact 14.7, with the complementary pivot surface 22.1 spaced from the pivot surface 14.7 as shown in FIG. 1, and with a selected angular separation a between the spring portion 18.4 and the arm 22. In that arrangement, the disc element 24 and the spring 18 cooperate so that, while a first fluid pressure is applied to the diaphragm 28 as indicated by the arrow 46, the disc element 24 is normally disposed in the dished configuration illustrated in FIG. 1 and positions the pin 42 to hold the contact arm 22 in the position shown against the bias spring 18. When the applied fluid pressure 46 is then increased to the selected actuating pressure of the switch device 10, the disc element 24 moves with snap action to an inverted dished configuration as will be understood for permitting the contact arm 22 to move up away from the bottom 12.2 of the base to another switch position indicated by broken lines **22*a* in FIG. 1 in response to bias of the spring 18, thereby to engage the pivot surface 22.1 with the first pivot surface 14.7 at point 22.8 and to pivot the arm to disengage the contacts 22.5 and 14.7**.

Figure 3:
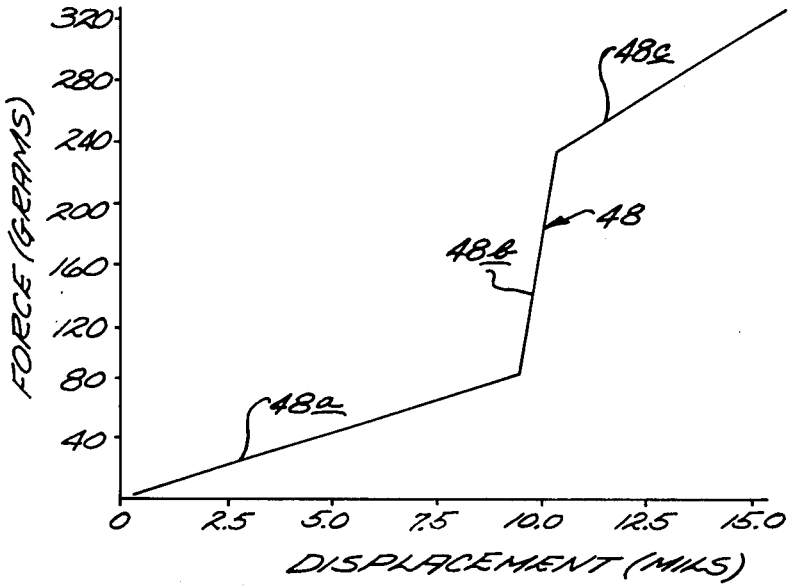
FIG. 3 is a graph illustrating response characteristics of the switch of this invention.

Subsequently, when the applied fluid pressure 46 is lowered to a selected reset pressure level for the switch device 10, movement of the diaphragm 28 allows the force converter 35 to reduce force on the dished element 24 so the element returns with snap action to the dished configuration shown in FIG. 1. As that snap-acting disc movement occurs, the initial movement of the disc moves the contact arm 22 to a closed contact position initially engaging contacts 22.5 and 14.7. That arm movement occurs against the bias of the spring 18 but, because the spring 18 has a relatively low spring rate and is arranged as discussed above, the reaction forces applied to the disc 24 during the contact closing movement is relatively limited as indicated by the portion **48*a* of the force/deformation curve for the spring 18 as shown in FIG. 3. Then, as snap-acting movement of the disc 24 continues in returning toward the original dished configuration of the disc, the force between the contacts 22.5 and 14.7 is increased without substantial increase in deformation of the spring 18 as is indicated by portion 48*b* of the spring curve. Finally, as snap-acting movement of the disc to its original dished configuration is completed and undergoes any intended or even excessive or undesired overtravel, the contact arm is pivoted oppositely so that the complementary pivot surface 22.1 of the arm is moved away from the pivot surface 16.7. That is, the arm then pivots around the point of engagement between the contacts 22.5 and 14.7 so that the first end 22.2 of the arm pivots (counterclockwise as viewed in FIG. 1) toward the bottom 12.2 of the switch base. Again, because the spring 18 has a relatively low spring rate and is arranged as described, the reaction forces applied to the disc 24 by the spring 18 during such overtravel disc movement is relatively limited as is indicated by the portion 48***c* of the spring curve shown in FIG. 3. In that way, the switch device 10 is adapted to return to its closed contact position and to accommodate any overtravel type of snap-acting disc movement in closing the switch contacts without substantially altering the condition response characteristics of the switch. Accordingly, manufacturing tolerances for switch components and for switch assembly can be relatively large with savings in cost while assuring manufacture of switches with consistently reproducible performance characteristics. In a preferred embodiment of the invention, the spring portion 18.4 is arranged to extend along the arm 22 and to have a selected angular separation a from the contact arm when in closed circuit position as shown in FIG. 1. However that spring portion has a relatively larger angular separation from the arm when the arm is in open circuit position. In that arrangement, the contact closing force of the spring 18 indicated by the curve portion 48*a* has an effective spring rate even lower than the spring rate of the spring during overtravel movement represented by the portion 48*c* of the curve of FIG. 3 as will be understood. Preferably also the contact arm 22 has lever tab means 22.4 thereon adapted to engage the terminal member 16 or the like during pivotal movement of the arm relative to the member 16. In that arrangement the lever means are located to engage the arm and move the arm laterally as the arm pivots so that the point 22.8 of pivotal engagement between the pivot surfaces 22.1 and 16.7 changes as pivoting of the arm continues and produces a wiping engagement between the switch contacts 22.5 and 14.7 for enhancing electrical engagement between the switch contacts.

It can be seen that the switch device 10 as above described is adapted to be easily and reliably manufactured and assembled but is adapted to be made with consistently reproducible pressure response characteristics. The switch device is particularly adapted to permit overtravel movement of the disc 24 during snap acting movement of the disc for closing switch contacts without substantially altering subsequent condition response characteristics of the switch. As a result, manufacture and assembly of the switch is adapted to be accomplished at low cost while achieving improved switch performance.

Figure 2:
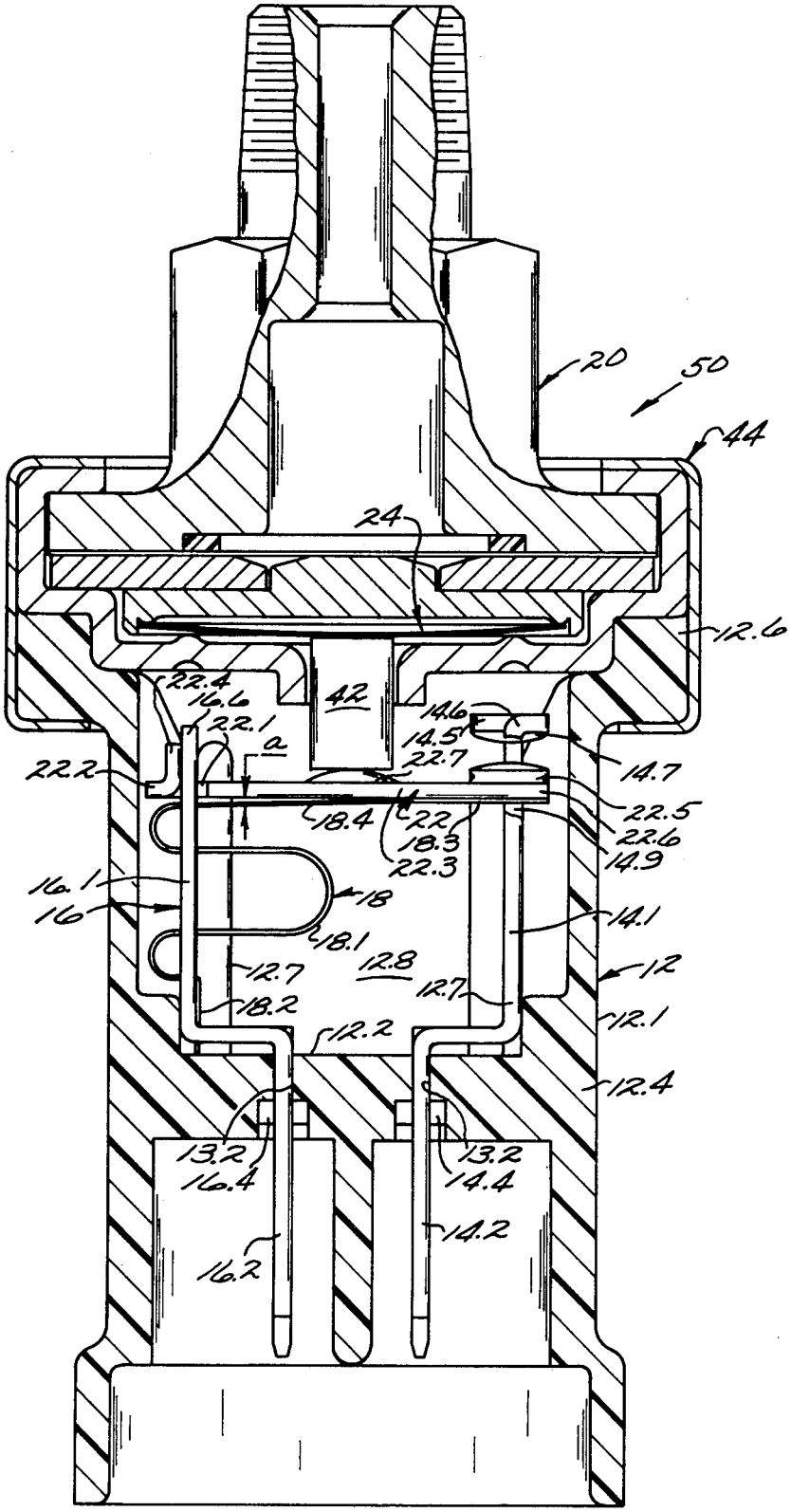
FIG. 2 is a section view similar to FIG. 1 of another alternate preferred embodiment of this invention.

In another alternate embodiment of this invention as shown in FIG. 2 (wherein comparable components are identified with corresponding reference numerals), an alternate switch device 50 is adapted to provide normally open switch contact operation. That is, in that device the contact 22.5 is located on an opposite side of the contact arm 22 and the terminal 14 has an opening 14.9 in which the stationary contact 14.7 is mounted to be engaged and disengaged by the movable contact 22.5. In that arrangement, the motion transfer pin 42 normally holds the arm 22 in a contacts open position as shown in FIG. 2 but when applied pressure 46 is increased to the selected actuating pressure of the switch, the disc 24 inverts and permits the spring 18 to move the switch sharply to closed contacts position.

Figure 4:
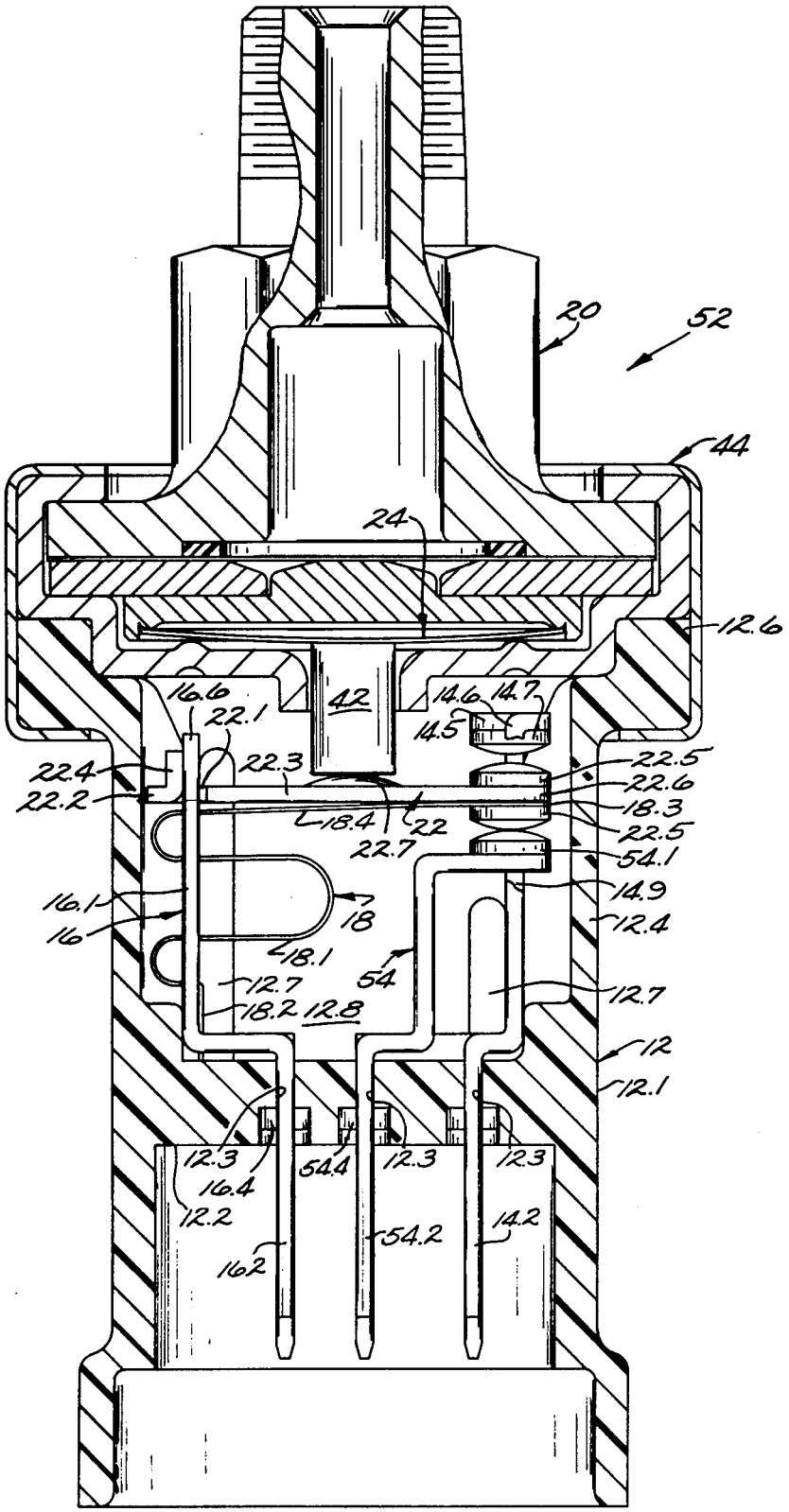
FIG. 4 is a section view similar to FIG. 1 of another alternate preferred embodiment of this invention.

In another alternate embodiment of this invention as shown at 52 in FIG. 4, another alternate embodiment of the invention provides double throw switch operation. That is, an additional terminal member 54 is mounted on the base 12 and has an additional stationary contact 54.1 mounted on one end of that terminal member. The motion transfer pin 42 normally holds the contact arm 22 in a first, closed contact switch position so that one movable contact 22.5 carried on the arm is normally engaged with the stationary contact 54.1. However, when the applied fluid pressure 46 is increased to the actuating pressure level of the switch, the disc 24 inverts and permits the spring 18 to move the contact arm to a second, closed contacts switch position engaging a second movable contact 22.5 with the stationary contact 14.7 as will be understood.

It should be understood that although particular embodiments of the condition responsive switch of this invention have been described by way of illustrating the invention, the invention includes all modifications and equivalents of the disclosed embodiments falling within the scope of the appended claim.

I claim:

1. An electrical control device having movable contact means mounted on a base for movement between first and second switch positions respectively spaced from and engaging stationary contact means and biased to one of said switch positions, and means responsive to the occurrence of a selected condition for moving the movable contact means to the other of said switch positions against said bias, characterized in that the movable contact means comprises terminal means mounted on the base having a first pivot surface disposed in spaced, facing relation to the base, a rigid contact arm having a complementary pivot surface arranged at one end thereof disposed in facing relation to the first pivot surface to be engaged with the first pivot surface for pivoting the opposite end of the arm between said switch positions, and spring means operatively connected between the terminal means and the contact arm for biasing the arm to engage said complementary pivot surface with the first pivot surface and to bias the contact arm to pivot to one of said switch positions, and in that the condition responsive means includes a dished disc element movable from one dished configuration to an inverted dished configuration with snap action in response to the occurrence of said condition for pivoting the arm to the other of said circuit positions against said spring bias and for permitting movement of the complementary pivot surface away from the first pivot surface to allow overtravel of the disc element during such snap action without substantially altering the condition response characteristics of the disc element in the device.

2. A pressure responsive electrical switch having movable contact means mounted on a base to be movable between a first switch position engaging a stationary contact means and a second switch position spaced from the stationary contact means, the movable contact means being biased to one of said switch positions, and pressure responsive means including a dished disc element movable from an original to an inverted dished configuration with snap action in response to the occurrence of a selected pressure condition in a pressure zone to be monitored for moving the movable contact means to the other of said switch positions against said bias, characterized in that the movable contact means comprises terminal means mounted on the base having a first pivot surface disposed in spaced, facing relation to the base, a rigid contact arm having a complementary pivot surface adjacent one end thereof disposed in facing relation to the first pivot surface to be engaged therewith for pivoting the arm between said switch positions, and a flat, electrically conductive spring having a relatively low spring rate and having a bight formed therein disposed with one end of the spring secured in electrically conductive relation to the terminal means and with an opposite end secured in electrically connected relation to the contact arm with the spring bight compressed for biasing the arm away from the base to engage the complementary pivot surface with the first pivot surface and for biasing the arm to pivot away from the base into one of said switch positions, and in that the dished disc element is coupled to the arm between said arm ends for pivoting the arm toward the base to the other of said switch positions against said bias in response to said snap acting movement of the disc element and for permitting movement of the complementary pivot surface away from the first pivot surface to allow overtravel of the disc element during such snap action without substantially altering the pressure response characteristics of the disc element in the switch device.

3. A pressure responsive switch as set forth in claim 2 further characterized in that the terminal means comprises a first plate member having one end mounted on the base in upstanding relation to the base, having an opening therein at an opposite end of the first plate member, and having said first pivot surface formed within the opening at one side of the opening, and the rigid arm has said one end fitted into said opening to dispose said complementary pivot surface in facing relation to the first pivot surface and to dispose one side of the arm in spaced, facing relation to the base, the spring having said one end thereof secured to said one end of the first plate member, having said spring bight accommodated in said plate opening, and having said opposite end of the spring secured to said one side of the contact arm to bias the arm to move away from the base.

4. A pressure responsive switch as set forth in claim 3 further characterized in that said opposite end of the spring is secured to said one side of the contact arm adjacent said opposite end of the arm and has a length of the spring extending along the contact arm with a selected angular separation from the arm such that movement of the arm for moving the complementary pivot surface of the arm away from said first pivot surface is adapted to engage the contact arm with said spring length along the length thereof for facilitating movement of the contact arm during said snap-acting overtravel movement of the disc element.

5. A pressure responsive switch as set forth in claim 3 further characterized in that lever means are provided on said contact arm for engaging said plate member during pivotal movement of the contact arm for laterally moving the point of engagement of said complementary pivot surface with said first pivot surface during pivotal movement of the arm to produce wiping engagement between the movable and stationary contacts of the switch for enhancing electrical engagement of said contacts.

* * * * *